US008011158B1

(12) United States Patent
Powell

(10) Patent No.: US 8,011,158 B1
(45) Date of Patent: Sep. 6, 2011

(54) FOOTING FOR SUPPORT OF STRUCTURE SUCH AS BUILDING

(75) Inventor: Kelly J. Powell, Cedar Springs, MI (US)

(73) Assignee: Sable Developing, Inc., Rockford, MI (US)

( * ) Notice: Subject to any disclaimer, the term of this patent is extended or adjusted under 35 U.S.C. 154(b) by 486 days.

(21) Appl. No.: 12/060,907

(22) Filed: Apr. 2, 2008

Related U.S. Application Data

(60) Provisional application No. 60/914,352, filed on Apr. 27, 2007.

(51) Int. Cl.

| | |
|---|---|
| ***E04B 1/00*** | (2006.01) |
| ***E02D 27/00*** | (2006.01) |
| ***E02D 27/32*** | (2006.01) |
| ***E02D 27/42*** | (2006.01) |

(52) U.S. Cl. ..... 52/742.14; 52/169.9; 52/294; 52/298; 52/299

(58) Field of Classification Search ..... 52/294, 52/295, 298, 169.9, 292, 296, 297, 299, 293.1–293.3, 52/169.8, 742.4, 742.13, 742.14
See application file for complete search history.

(56) References Cited

U.S. PATENT DOCUMENTS

| | | | | |
|---|---|---|---|---|
| 1,514,714 | A | | 11/1924 | Needham et al. |
| 2,078,069 | A | | 4/1937 | Eliel |
| 2,695,159 | A | | 11/1954 | Bridwell |
| 3,260,025 | A | | 7/1966 | Van Der Lely |
| 3,561,175 | A | | 2/1971 | Best et al. |
| 3,667,237 | A | | 6/1972 | Dougan |
| 3,673,750 | A | | 7/1972 | Bokvist et al. |
| 3,688,457 | A | | 9/1972 | Sherno |
| 3,956,859 | A | | 5/1976 | Ingestrom |
| 4,328,651 | A | | 5/1982 | Gutierrez |
| 4,605,336 | A | | 8/1986 | Slaw, Sr. |
| 4,694,625 | A | | 9/1987 | Gregory |
| 4,996,807 | A | | 3/1991 | Walgamuth |
| 5,138,808 | A | | 8/1992 | Bengtson et al. |
| D354,575 | S | | 1/1995 | Cusimano |
| 5,426,896 | A | | 6/1995 | Sloma |
| 5,433,049 | A | | 7/1995 | Karlsson et al. |
| 5,470,178 | A | * | 11/1995 | Weholt ..... 405/152 |
| 5,493,838 | A | | 2/1996 | Ross |
| 5,511,350 | A | * | 4/1996 | Nivens ..... 52/293.3 |
| 5,678,372 | A | | 10/1997 | Thomson et al. |
| 5,794,393 | A | | 8/1998 | Fearn |
| 5,882,140 | A | | 3/1999 | Yodock, Jr. et al. |
| 5,906,075 | A | | 5/1999 | Sowers |
| 6,131,350 | A | | 10/2000 | Sanders |
| 6,205,717 | B1 | * | 3/2001 | Shall et al. ..... 52/89 |
| 7,003,918 | B2 | | 2/2006 | Williams |

(Continued)

*Primary Examiner* — Eileen Lillis
*Assistant Examiner* — William V Gilbert
(74) *Attorney, Agent, or Firm* — Van Dyke, Gardner, Linn & Burkhart, LLP

(57) ABSTRACT

A foundation system, such as a frost-protected foundation system, includes an elongated body having a lower base surface, an upper support surface and side surfaces between the lower base surface and the upper support surface. The base surface is adapted to be supported on a ground surface and the upper support surface is adapted to supporting at least a portion of a structure. The body may be made substantially from a polymeric material, such as a high density crush resistant material, an extruded polystyrene insulation, or the like. At least one of said side surfaces is at an acute angle to said base surface. An architectural structure made with the frost-protected foundation system includes a slab supported with the upper support surface.

29 Claims, 16 Drawing Sheets

U.S. PATENT DOCUMENTS

| | | | | |
|---|---|---|---|---|
| 7,127,865 | B2 | 10/2006 | Douglas | |
| 2002/0046521 | A1* | 4/2002 | Steinacker, Sr. | 52/274 |
| 2003/0033773 | A1* | 2/2003 | Houpapa et al. | 52/299 |
| 2005/0252106 | A1* | 11/2005 | Linse | 52/169.9 |
| 2005/0252107 | A1 | 11/2005 | Linse | |
| 2006/0119011 | A1* | 6/2006 | Blackmore | 264/449 |

* cited by examiner

FOOTING FOR SUPPORT OF STRUCTURE SUCH AS BUILDING

CROSS REFERENCE TO RELATED APPLICATION

This application claims priority from U.S. provisional patent application Ser. No. 60/914,352 filed on Apr. 27, 2007, the disclosure of which is hereby incorporated herein by reference in its entirety.

BACKGROUND OF THE INVENTION

The present invention is directed to a foundation system for supporting an architectural structure and, in particular, to a frost-protected foundation system.

A known frost-protected shallow foundation 10 is a practical alternative to a deeper, more-costly known full foundation 8 in cold regions with seasonal ground freezing and the potential for frost heave (FIGS. 1 and 2). Shallow foundation 10 may include a combination slab 12 and footing 14 which are made of concrete that is made concurrently from the same concrete pour as shown. Alternatively, the foundation may be poured separately and utilities, such as rough plumbing, wiring conduit, or the like, laid out before the slab is poured. An insulation sheet 16 raises soil temperature and the frost depth around the building thereby allowing foundation depths as shallow as sixteen inches for many areas. The known shallow foundation is thus an improvement over the full foundation.

However, the foundation must still be formed using concrete forms which is labor intensive. Also, the foundation is cured and inspected prior to backfilling and the backfilling completed prior to installing plumbing. The plumbing is inspected prior to pouring the concrete floor. All of the delays associated with these sequential steps add further to the cost of the structure. Also, resistance to heat transmission is limited to the characteristics of insulation sheet 16.

SUMMARY OF THE INVENTION

A foundation system for supporting an architectural structure, an architectural structure utilizing this foundation system and method of constructing an architectural structure, according to an aspect of the invention, includes providing an elongated body having a lower base surface, an upper support surface and side surfaces between the lower base surface and the upper support surface. The base surface is adapted to be supported on a ground surface and the upper support surface is adapted to supporting at least a portion of a structure. According to this aspect of the invention, the body is made substantially from a polymeric material, such as (i) a high density crush resistant material or (ii) an extruded polystyrene insulation.

A foundation system for supporting an architectural structure, an architectural structure utilizing this foundation system and method of constructing an architectural structure, according to another aspect of the invention, includes providing an elongated body having a lower base surface, an upper support surface and side surfaces between the lower base surface and the upper support surface. The base surface is adapted to be supported on a ground surface and the upper support surface is adapted to supporting at least a portion of a structure. According to this aspect of the invention, at least one of said side surfaces is at an acute angle to the base surface.

A foundation system for supporting an architectural structure, an architectural structure utilizing this foundation system and method of constructing an architectural structure, according to another aspect of the invention, includes providing a foundation system comprising an elongated body having a lower base surface, an upper support surface and side surfaces between the lower base surface and the upper support surface. The base surface is adapted to be supported on a ground surface, and the upper support surface is adapted to support at least a portion of the architectural structure. A concrete form is defined with the elongated body. The concrete form is adjacent said upper support surface and includes a generally vertical support surface. A poured concrete slab is contained by the generally vertical support surface. The concrete slab is supported with the upper support surface. In this manner, the foundation system provides both a support for the concrete slab and a form for use in pouring the concrete slab.

These and other objects, advantages and features of this invention will become apparent upon review of the following specification in conjunction with the drawings.

DESCRIPTION OF THE PREFERRED EMBODIMENT

Figure 1:
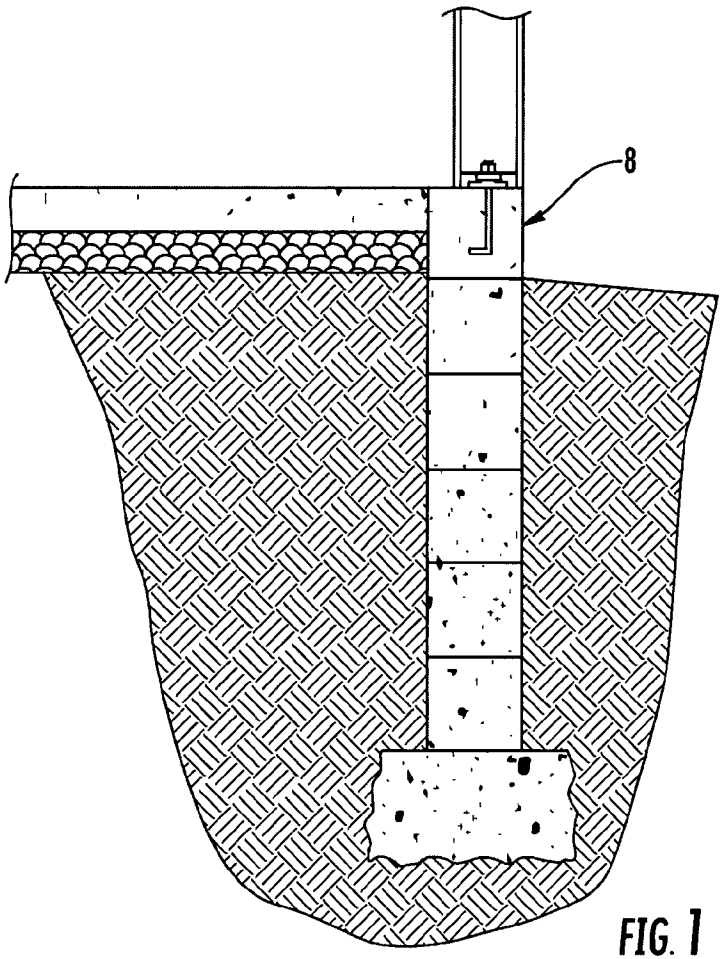
FIG. 1 (PRIOR ART)
FIG. 1 is a side elevation of a known full foundation.
Figure 2:
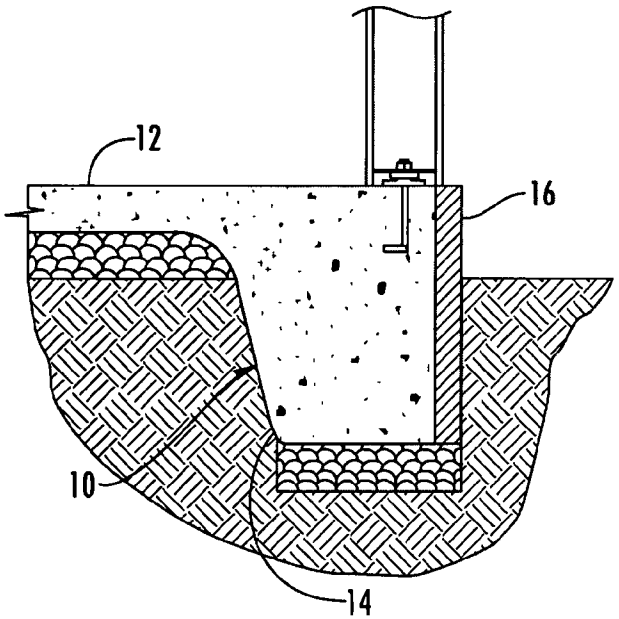
FIG. 2 (PRIOR ART)
FIG. 2 is the same view as FIG. 1 of a known frost-protected shallow foundation.
Figure 4:
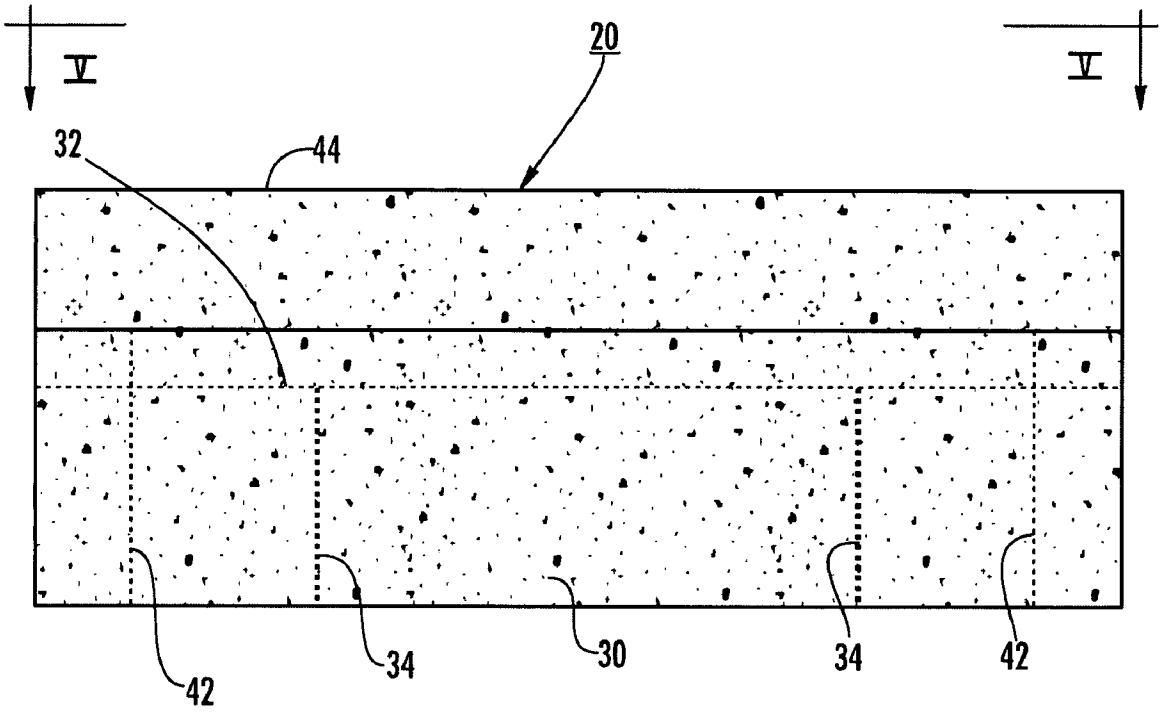
FIG. 4 is a side elevation taken from the direction IV-IV of the foundation system body in FIG. 3.
Figure 3:
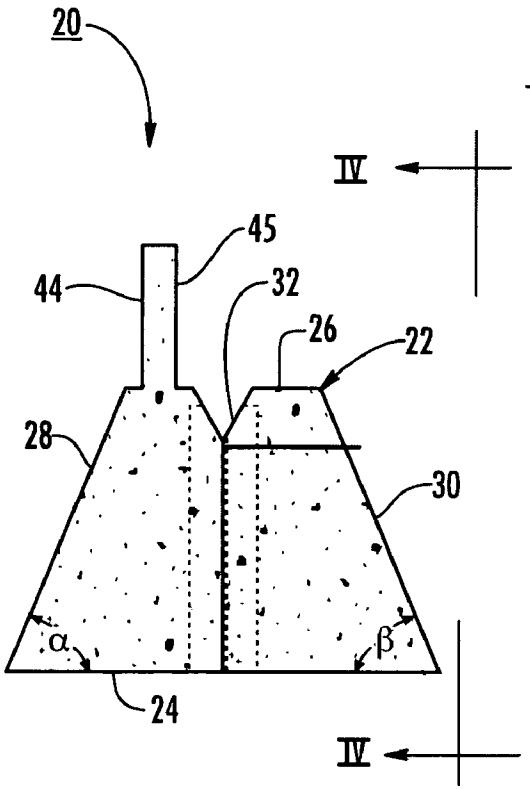
FIG. 3 is an end elevation of a frost-protected foundation system body according to an embodiment of the invention.
Figure 5:
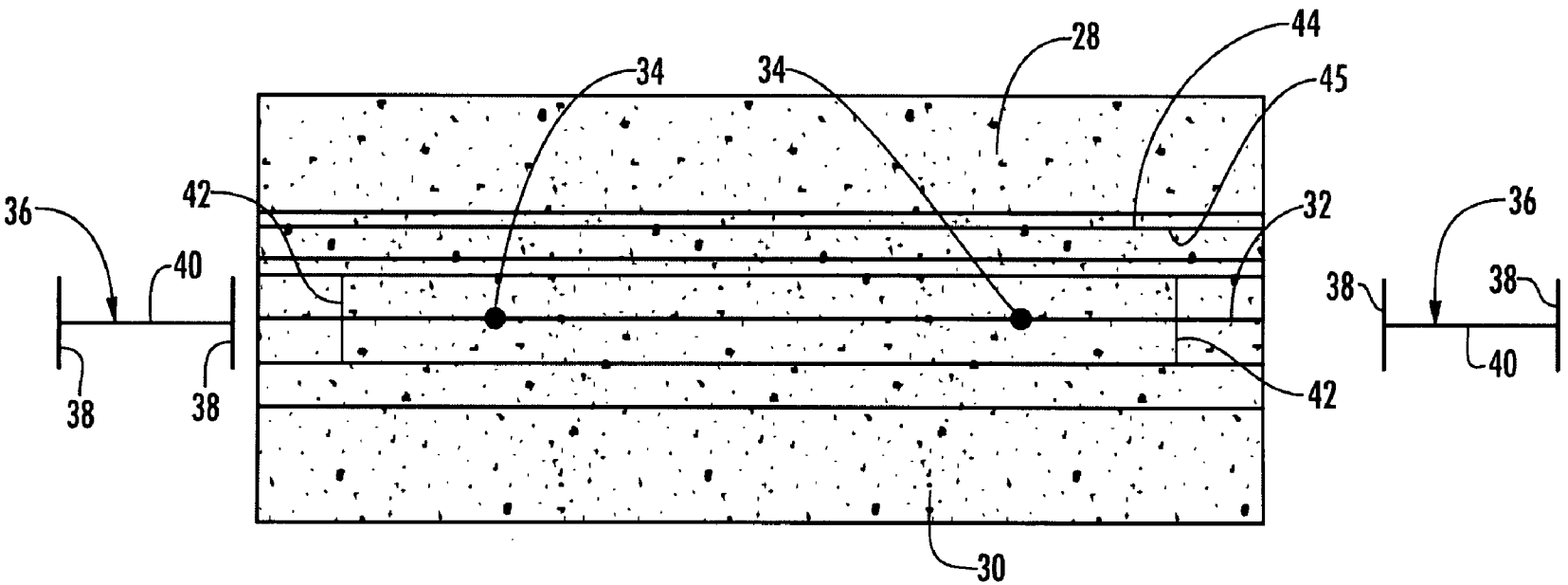
FIG. 5 is a top plan view taken from the direction V-V of the foundation system body in FIG. 4.

Referring now to the drawings and the illustrative embodiments depicted therein, a foundation system, such as a frost-protected foundation system, 20 for supporting an architectural structure includes a plurality of elongated bodies 22 connected in tandem, only one of which is illustrated (FIGS. 3-5). Each elongated body has a lower base surface 24, an upper support surface 26 and side surfaces 28, 30 between lower base surface 24 and said upper support surface 26. Base surface 24 is adapted to be supported on a ground surface, such as undisturbed soil. Upper support surface 26 is adapted to supporting at least a portion of a structure, as will be described in more detail below. Side surface 28 is an outer side surface that is intended to face away from the structure and to be generally surrounded by fill material. Side surface 30 is an inner side surface that is intended to face inward of the structure and to be generally surrounded by compacted soil.

One or both of side surfaces 28, 30 are at an acute angle to base surface 24. In particular, outer side surface 28 is at an angle alpha ($\alpha$) to base surface 24. Angle alpha ($\alpha$) is an acute angle such that outer side surface 28 slopes upwardly inwardly. Inner side surface 30 is at an angle beta ($\beta$) to base surface 24. Angle beta ($\beta$) is an acute angle such that inner side surface 30 slopes upwardly outwardly. In this manner, the elongated body has a generally frusto-conical cross-sectional configuration, as best seen in FIG. 3. Sloping surfaces 28, 30 impart stability to elongated body 22 because as soil and/or fill contacts the sloping surface(s) during backfilling, the soil and/or fill presses the body against the undisturbed soil supporting the elongated body. This is because, as backfilled with fill and/or compacted soil, the added material applies a downward force component to the elongated body. This reduces the tendency for the backfilling process to topple the elongated member. This allows the elongated member to be made from a light-weight material, such as a polymeric material while facilitating stability during the back-filling process. In the illustrated embodiment, angles alpha ($\alpha$) and/or beta ($\beta$) can be within the range of from approximately 55 degrees or less to approximately 70 degrees or more.

Upper support surface 26 defines an upwardly opening trough 32. Trough 32 is configured to receiving a concrete reinforcing rod, as will be explained in more detail below. One or more anchor openings 34 are formed as a through opening extending from the bottom of trough 32 in upper support surface 26 to the lower base surface 24. As will be described in more detail below, each anchor opening 34 is configured to receiving an anchoring rod extending below ground surface level to anchor the foundation element to its supporting ground.

Foundation system 20 includes connectors 36 that are configured to mechanically connect two adjacent elongated bodies in tandem (FIG. 5). Connector 36 includes end portions 38 that are configured to be retained in respective connector receiving slots 42 at end portions of the elongated bodies to couple with the elongated bodies. Connectors 36 further include a central portion joining the end portions. Connectors 36 can be applied to elongated members arranged adjacent to each other simply by sliding the connector into the connector receiving slots from above. This allows the elongated members to be quickly joined without special tools or chemical adhesives. Also, special configurations are not required at the ends, such as dovetail joints. However, other joining techniques may be used.

A concrete form may be defined by a vertical member 44 that is formed in elongated body 22 extending upwardly adjacent to upper support surface 26. A vertical member includes a generally vertical surface 45. As will be described in more detail below, not only does vertical member 44 provide insulation against heat transfer from the structure, such as a concrete slab, but it also provides a permanent form for pouring of the concrete slab.

In the illustrated embodiment, the elongated body is made substantially from a lightweight material, such as a polymeric material. This polymeric material may be a high density crush resistant material, such as crush resistant urethane foam. Alternatively, elongated body 22 may be made from extruded polystyrene insulation. Other materials, particularly polymeric materials, may be used as would be apparent to the skilled artisan. Elongated body 22 may be formed in many convenient ways. For example, it may be formed by extrusion. Alternatively, it may be formed by a hot-wire cutting from a block of material. Connector receiving slots 42 and anchor openings 34 can be added after the elongated body is formed.

Figure 6:
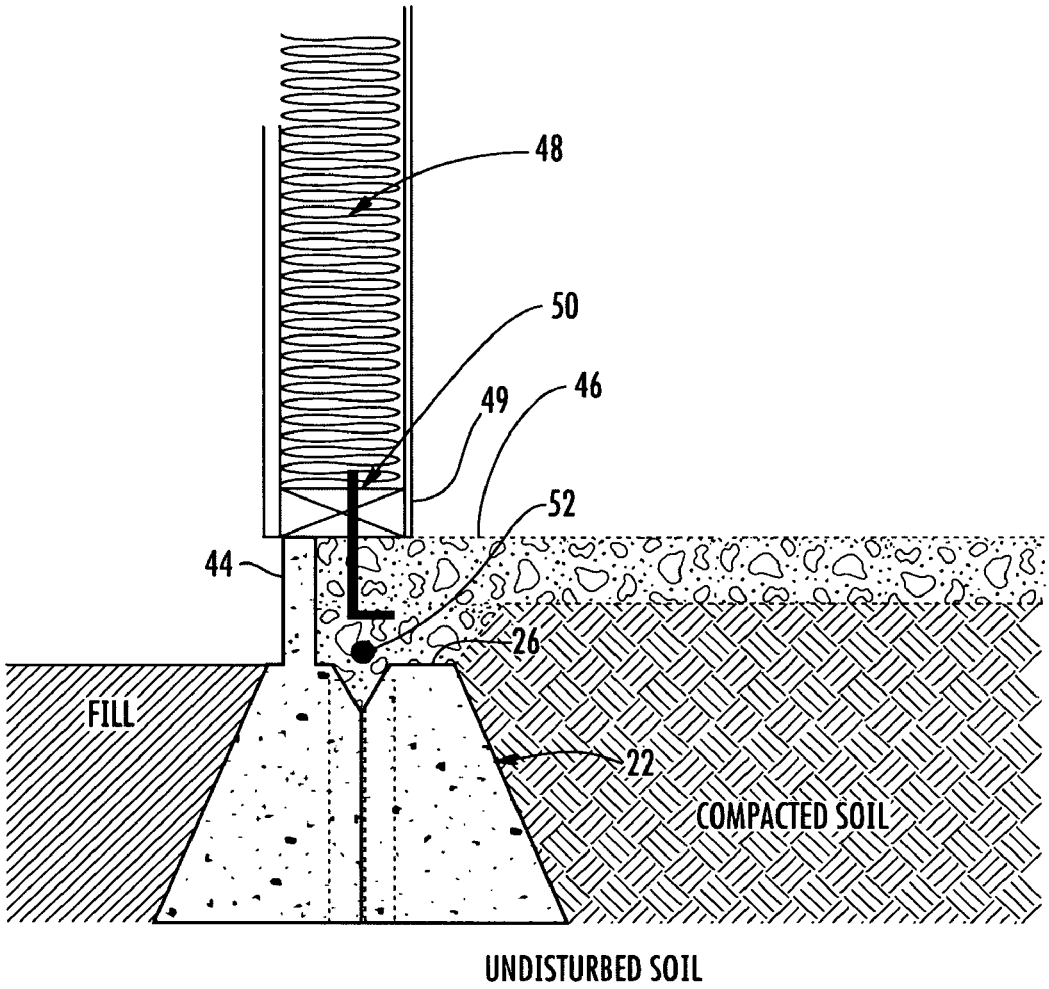
FIG. 6 is a sectional side elevation of an architectural structure having a foundation system according to an embodiment of the invention.
Figure 7:
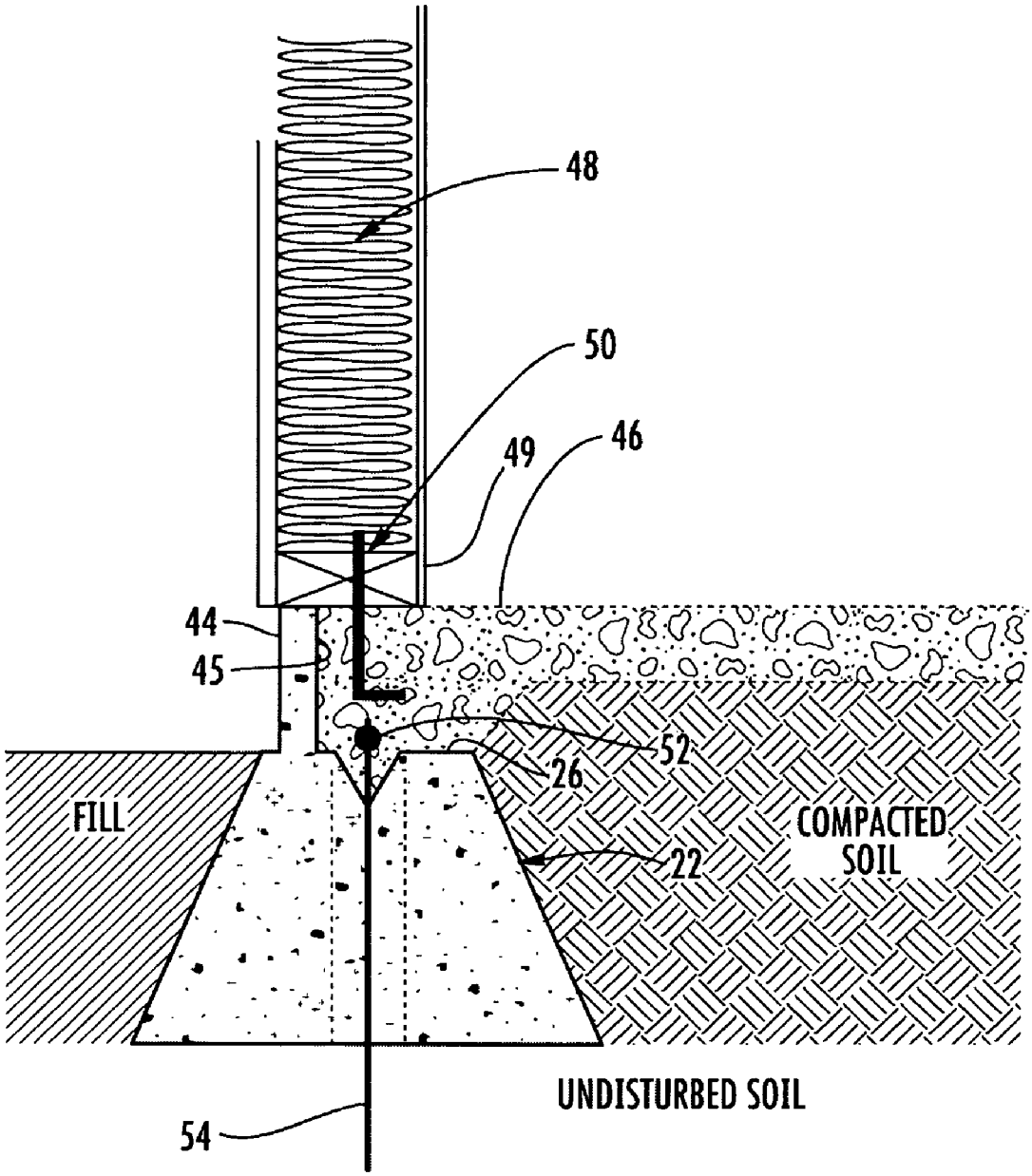
FIG. 7 is the same view as FIG. 6 taken at a different portion of the body thereby illustrating an anchoring rod anchoring the foundation system.

An example of an architectural structure made with foundation system 20 is illustrated in FIGS. 6 and 7. A concrete reinforcing rod 52 is positioned in trough 32. Reinforcing rod 52 becomes formed in a concrete slab 46 supported by support surface 26 when the slab is poured. An anchoring rod 54, which may be formed from fiberglass or other non-corrosive material, extends in each anchor opening 34 below ground surface level to anchor the elongated body, and, hence, the foundation system, to the ground. In the illustrated embodiment, each anchoring rod 54 may extend adjacent to concrete reinforcing rod 52, as illustrated in FIG. 7, and may be connected with the concrete reinforcing rod 52, such as by using conventional reinforcing rod-tying techniques.

Once foundation system 20 is assembled and stably positioned, such as by applying anchoring rods 54 and connectors 36, backfilling takes place. This may be accomplished by compacting a material, such as soil or stone, against inner side surface 30 up to approximately the level of upper support surface 26. This backfilled material then serves as a support, along with upper support surface 26 and the concrete form defined by vertical member 44, for the in situ pouring of concrete slab 46. The backfilling may further include applying fill against outer side surface 28.

Reinforcing rod 52 is positioned in trough 32 and may be connected with the anchoring rods. Bodies 22 can be mitered at 45 degrees using a mitering saw, or the like, to form corners in the foundation. Anchor straps or bolts 50 can be positioned to retain treated sill plate 49 and, hence, stud wall 48 in position. Slab 46 can be poured directly against the upper support surface and vertical member 44 of the elongated body and against the compacted soil. No removable concrete forms are used in the illustrated embodiment.

Figure 8:
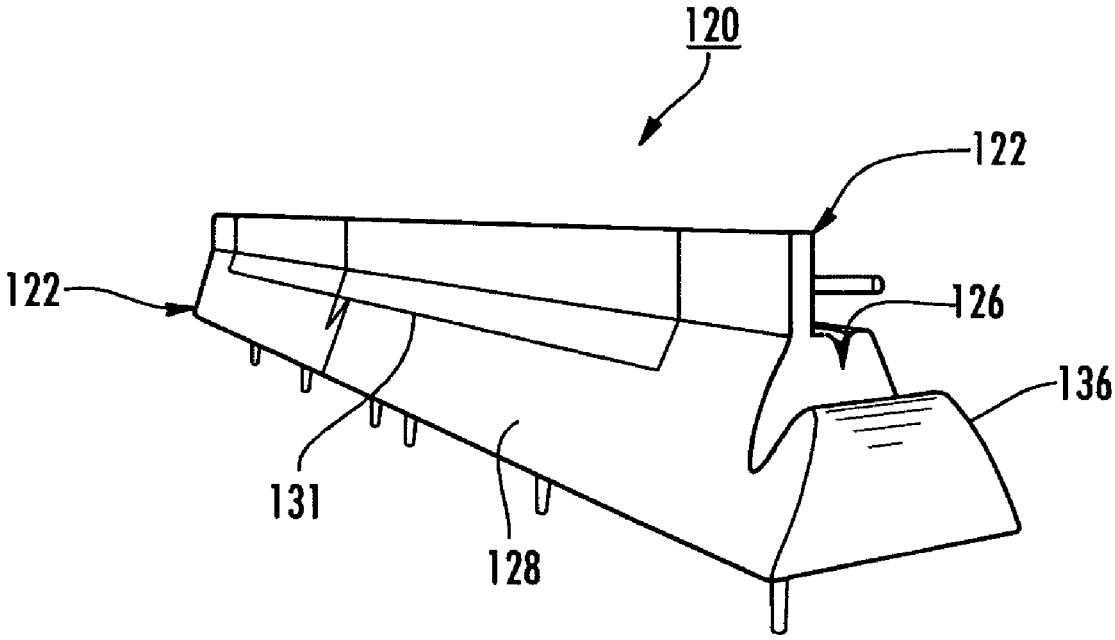
FIG. 8 is a perspective view of a foundation system according to an alternative embodiment of the invention.
Figure 9:
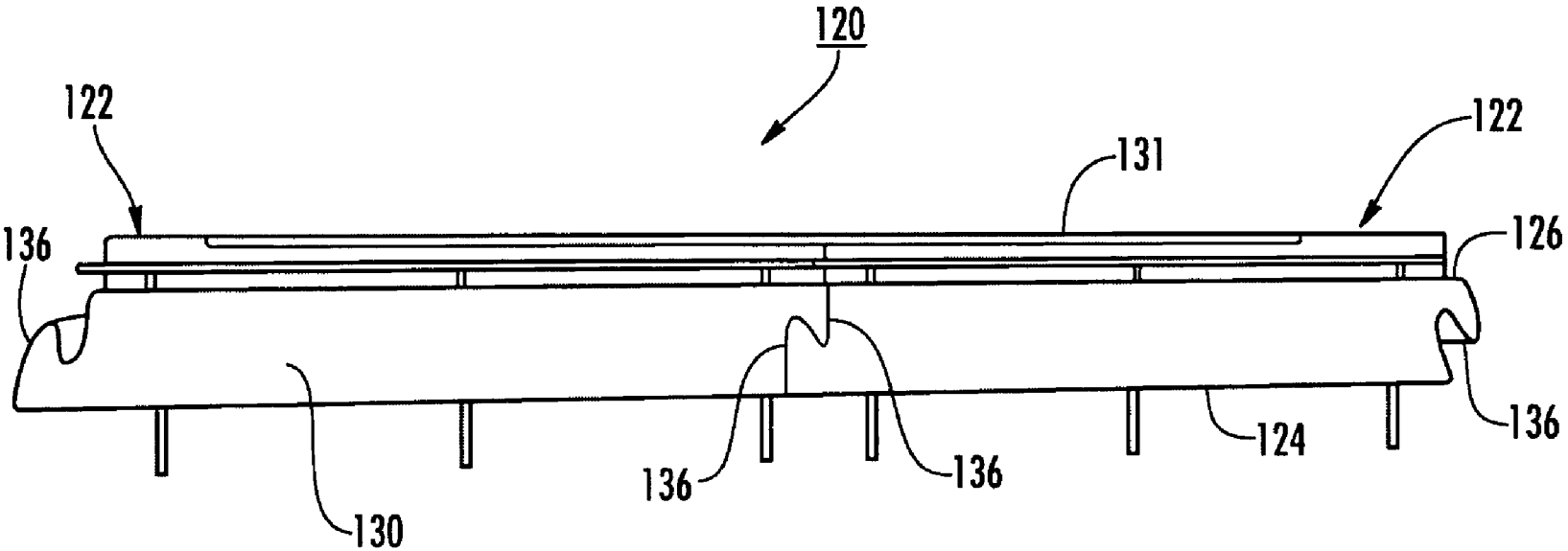
FIG. 9 is a side elevation of the foundation system in FIG. 8 taken from an interior side.

In an alternative embodiment, a foundation system 120 includes a plurality of elongated bodies 122 that are connected in tandem (FIGS. 8 and 9). In addition to a lower base surface 124 and an upper support surface 126, bodies 122 include an outer side surface 128 that is intended to face away from the structure at an inner side surface that is intended to face inward of the structure. As with prior embodiments, one or both side surfaces 126, 128 are at an acute angle to base surface 124. A footing guard 131 is shown outward of outer side surface 128 to protect the footing from damage from physical impact, from termite infestation, and the like. Guard 131 is made of a durable material, such as galvanized metal, or the like. Foundation system 120 may include a connector 136 to join adjacent ends of bodies 122. Connector 136 is defined by overlapping complementary shapes of the ends of the bodies.

Figure 10:
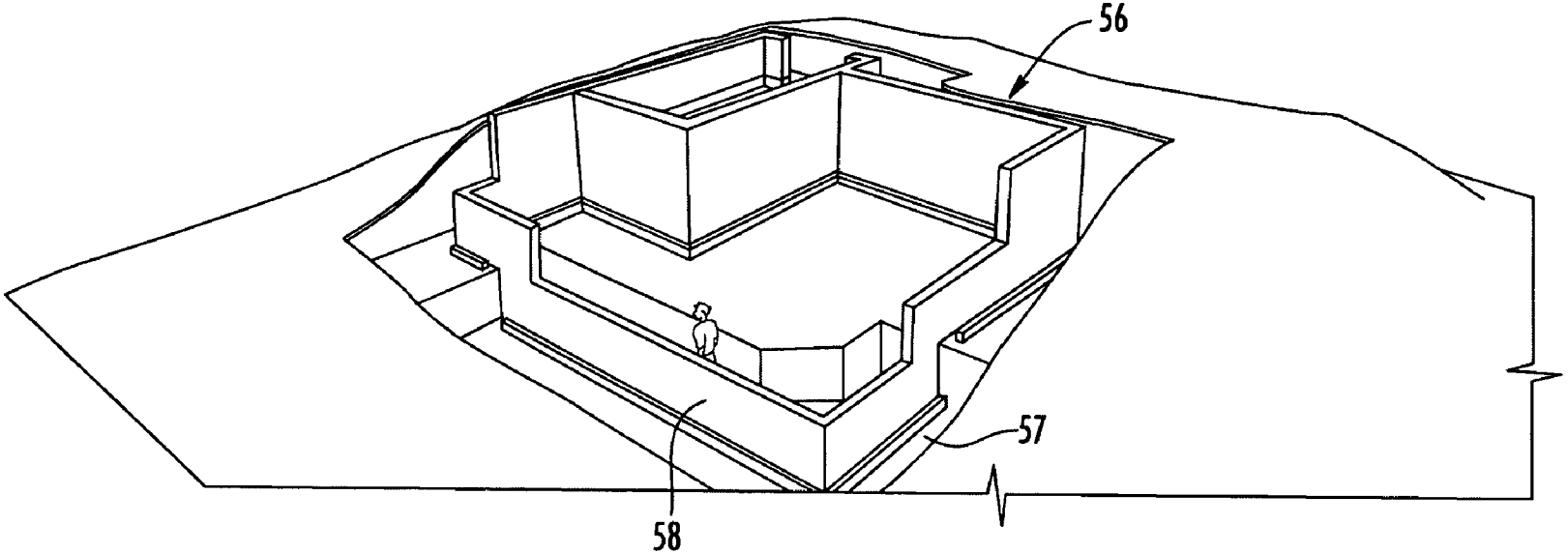
FIG. 10 (PRIOR ART)
FIG. 10 is a perspective view of a prior art foundation system for use with a walkout lower level structure.
Figure 11:
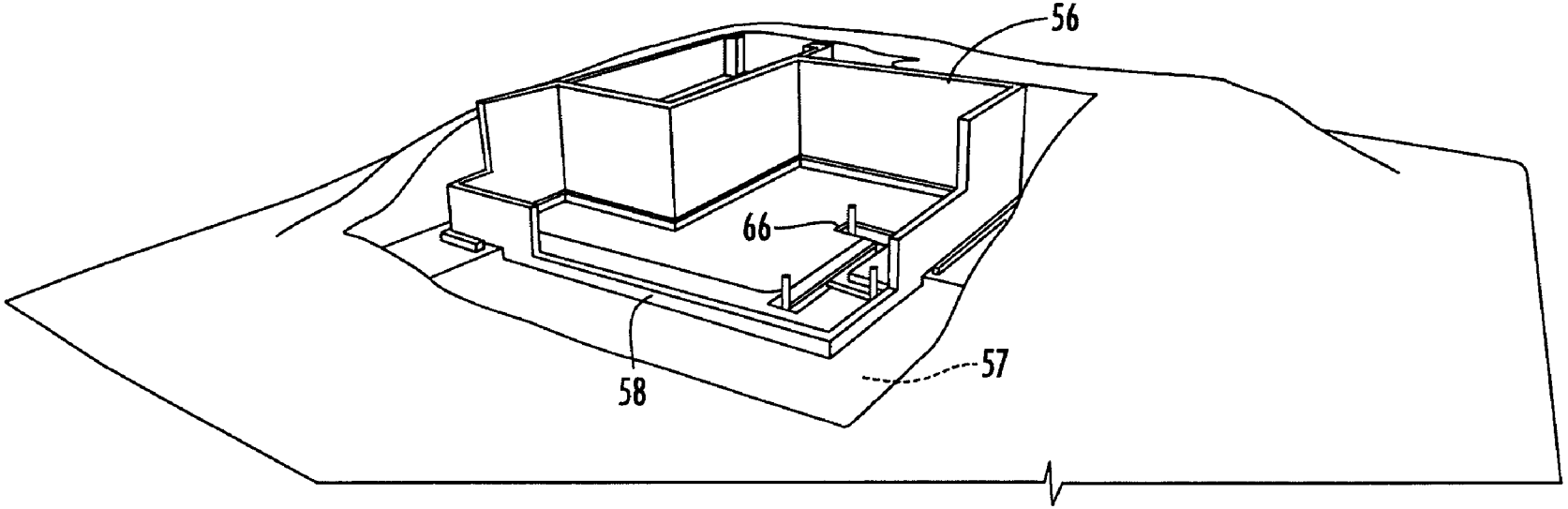
FIG. 11 (PRIOR ART)
FIG. 11 is the same view as FIG. 10 after completion of backfill 14 at the frost wall and rough plumbing installed.

A prior art foundation system 56 for use with a structure having multi-level access, such as a walkout lower level, includes a 42-inch high frost wall 58 that is set in a trench 57 on conventional footings (FIGS. 10 and 11). Once the foundation, including frost wall 58, is inspected, trench 57 is backfilled prior to installation of rough plumbing 66. This prior art system calls for multiple visits of inspectors to inspect the foundation and the rough plumbing.

Figure 12:
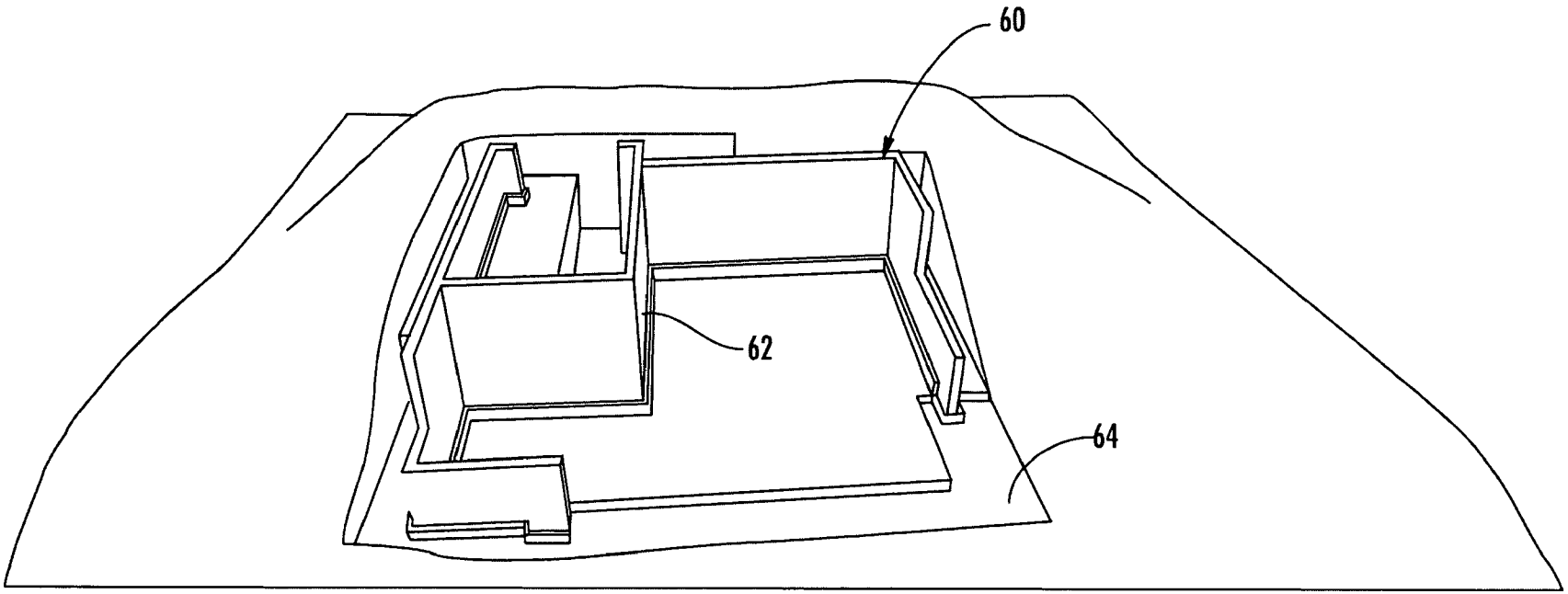
FIG. 12 is the same view as FIG. 10 with site preparation for a foundation system according to the illustrated embodiments of the invention.
Figure 13:
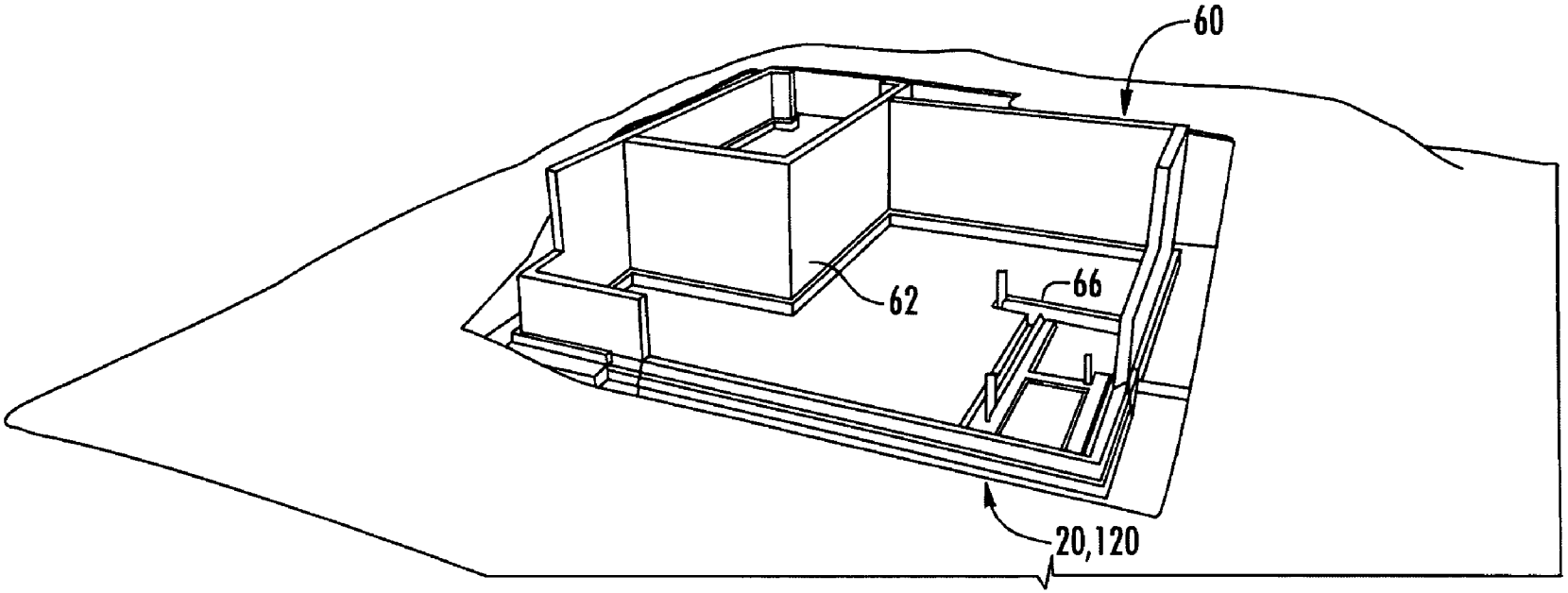
FIG. 13 is the same view as FIG. 12 with the foundation system and rough plumbing installed.
Figure 14:
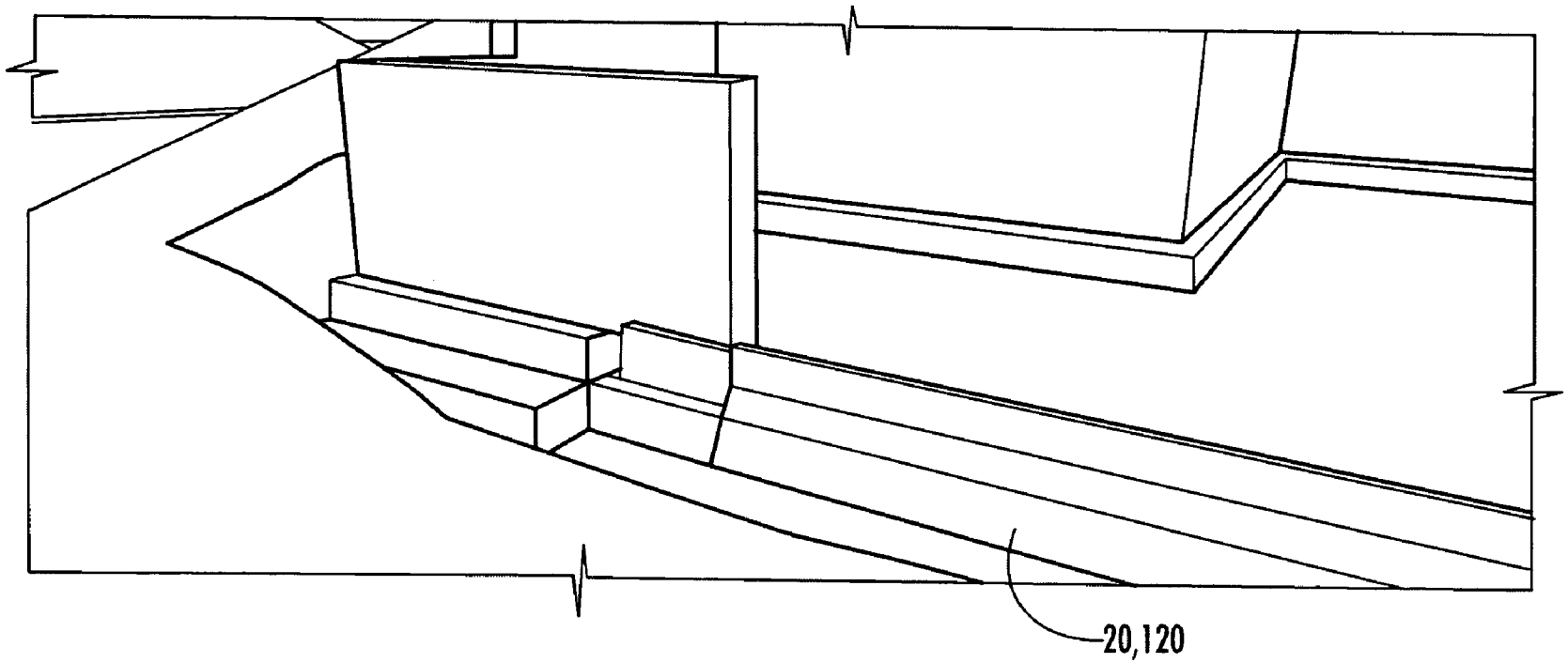
FIG. 14 is an enlarged view of a portion of the structure in FIG. 13 to illustrate additional details thereof.
Figure 15:
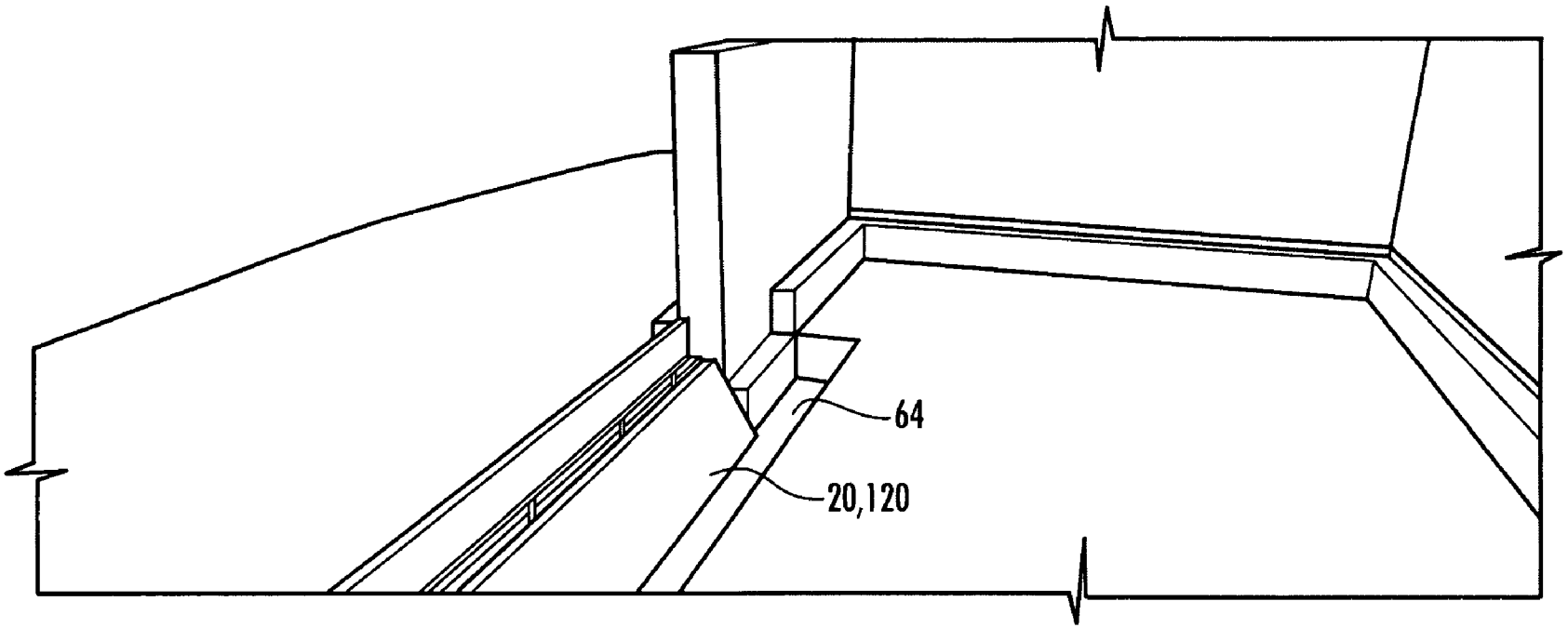
FIG. 15 is a perspective view of the portion of the structure shown in FIG. 14 taken from an interior side.
Figure 16:
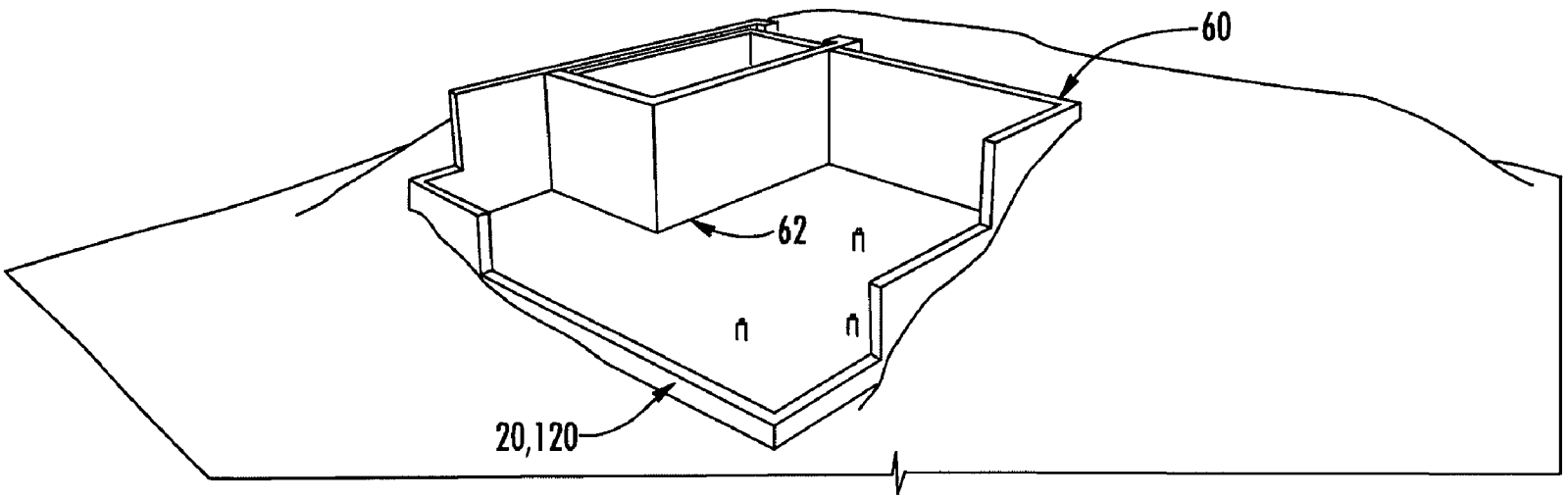
FIG. 16 is the same view as FIG. 13 with the concrete slab poured.
Figure 17:
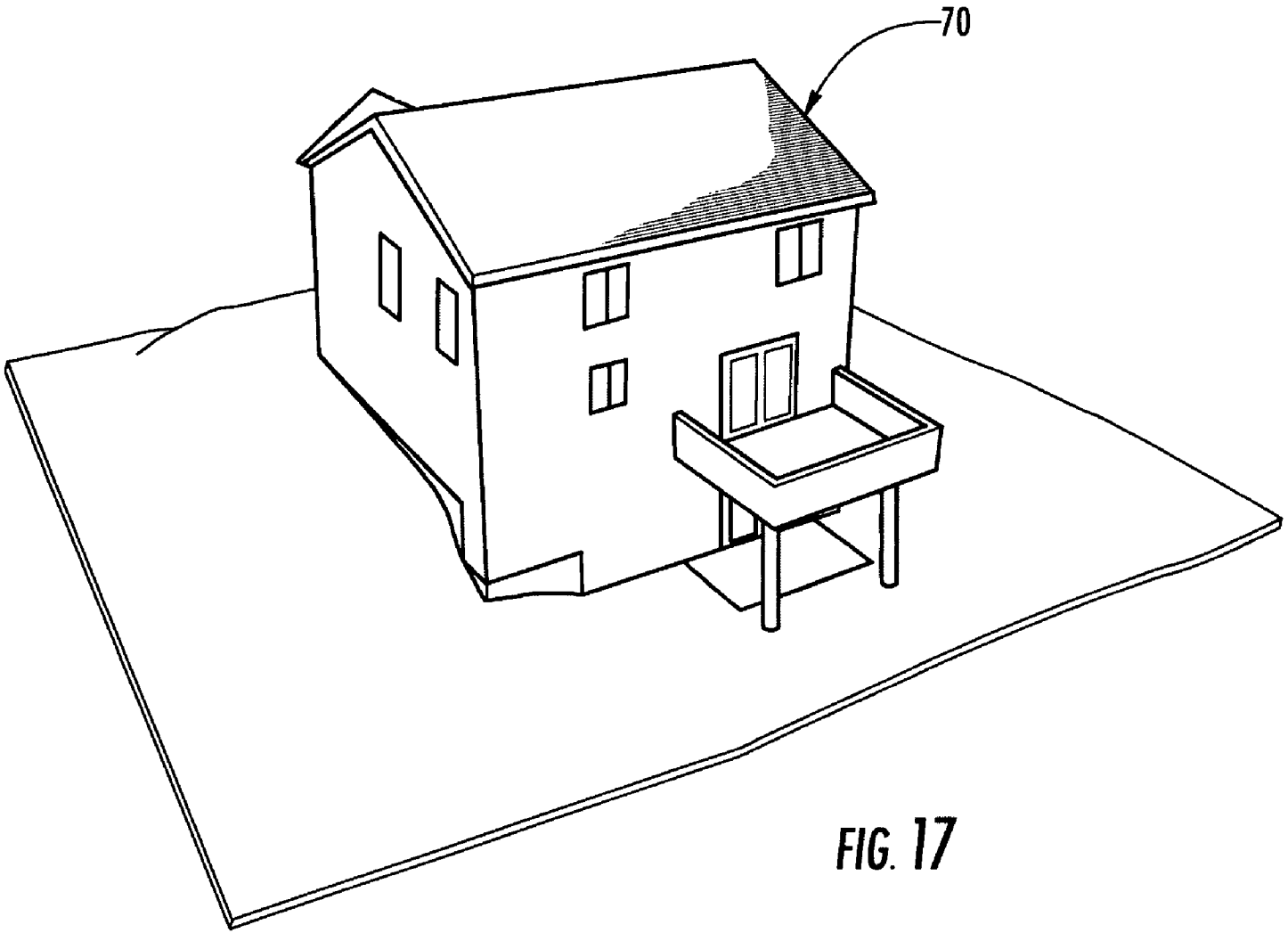
FIG. 17 is a perspective view of a residential structure built on the foundation system illustrated in FIGS. 12 through 16.

A foundation 60 made up of a combination conventional foundation 62 and a foundation system 20, 120 may be provided for use with, for example, structures having multi-level access, such as a walkout lower level. Conventional foundation 62 defines a majority of the basement while foundation system 20, 120 is used at the walkout portion of the basement in lieu of frost wall 58. As illustrated in FIG. 12, only a shallow excavation, such as approximately a six (6) inch deep trench 64, is required for foundation system 20, 120. Once foundation 60 is complete, rough plumbing 66 may be installed prior to backfilling of the site, as seen in FIG. 13. Once the foundation system 20, 120 is inspected, which can occur at about the same time as inspection of rough plumbing 66, the site can be backfilled. The concrete slab can then be poured as seen in FIG. 16. The result is a foundation that supports a conventional walkout residential structure 70 (FIG. 17).

Figure 18:
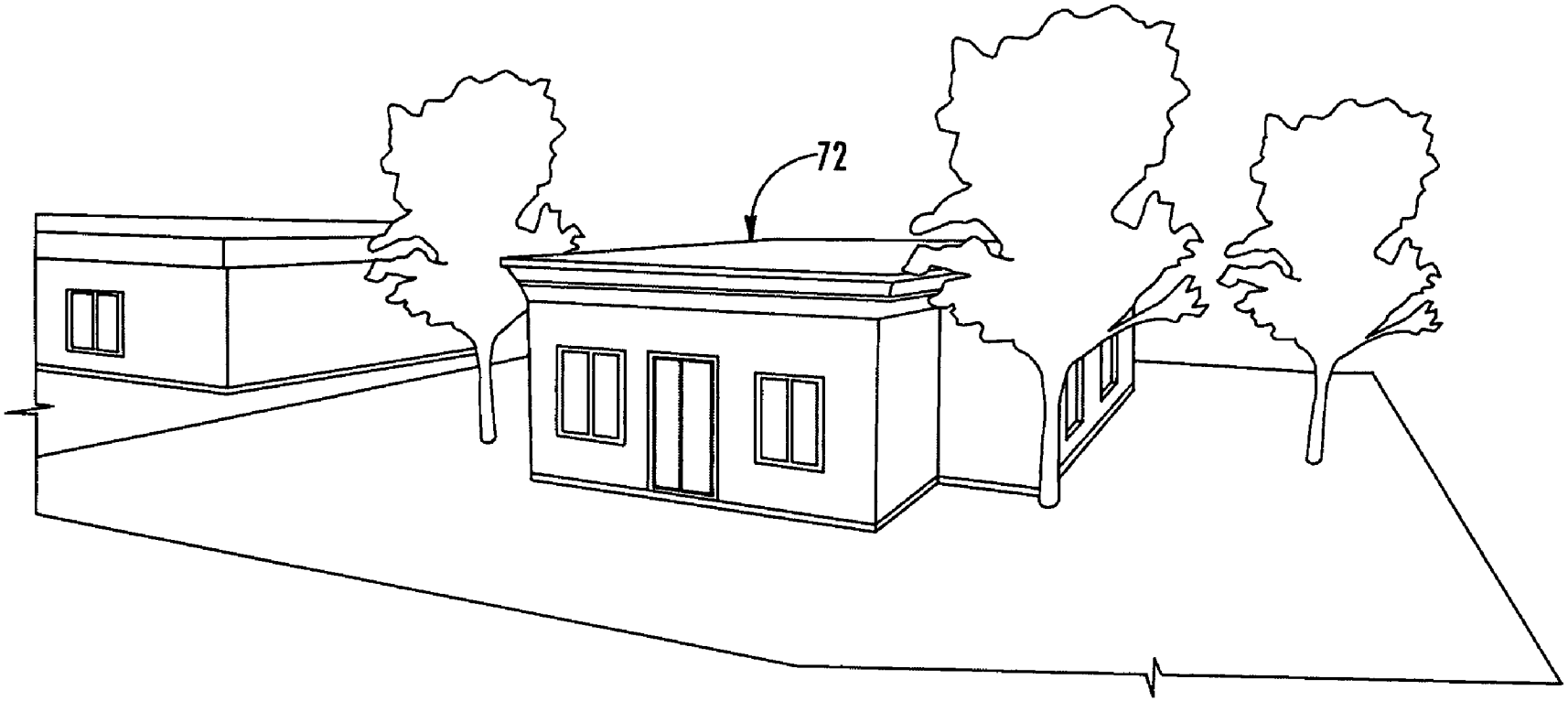
FIG. 18 is a perspective view of a commercial structure built on a foundation system according to the illustrated embodiments of the invention.

In addition to residential structures, foundation system 20, 120 can be used with a commercial structure 72 (FIG. 18) which may include office buildings, banks, gas stations, and the like. It can also be used with structures intended to replace pole barns, garages, and the like.

Foundation structure 20, 120 may be capable of reducing costly delays for inspections concrete curing, and the like. Once the foundation is set, the rough plumbing can be run and both inspected at the same time prior to backfilling. Once backfilling is complete, the slab can be poured.

Thus, it is seen that the illustrated embodiment provides a foundation system, such as a frost-protected foundation system that can be manufactured and shipped to the job sight and easily assembled at the job site. Once the foundation system is assembled and backfilled, the slab can be poured to complete the ground floor structure. The resulting appearance to the homeowner is generally indistinguishable from a conventional foundation. In addition to its ease of use, the foundation system disclosed herein is capable of enhanced energy usage efficiency.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A method of constructing an architectural structure, said method comprising:

providing a foundation system comprising an elongated body having a lower base surface, an upper support surface and side surfaces between said lower base surface and said upper support surface;

supporting said base surface on a ground surface;

supporting at least a portion of the architectural structure with said upper support surface;

defining a concrete form with said elongated body, said concrete form adjacent said upper support surface, said concrete form including a generally vertical support surface extending substantially the longitudinal length of said elongated body, wherein said upper support surface defines an upwardly opening trough thereby dividing said upper support surface into two upper surface portions and wherein said generally vertical support surface extends upwardly from one of said upper surface portions, said trough having a lower surface terminating between said upper support surface and said lower base surface; and pouring a concrete slab in situ against said upper support surface and said generally vertical support surface wherein the concrete slab is at least partially contained by said generally vertical support surface while curing, wherein said concrete slab is supported with said upper support surface, wherein said foundation system provides both a support for said concrete slab and a form for use in pouring said concrete slab.

2. The method as claimed in claim 1 wherein at least one of said side surfaces is at an acute angle to said base surface.

3. The method as claimed in claim 2 wherein both of said side surfaces are at an acute angle to said base surface and wherein said side surfaces are closer together adjacent said upper support surface than adjacent said base surface.

4. The method as claimed in claim 1 including providing a concrete reinforcing rod in said trough, said reinforcing rod being in said slab.

5. The method as claimed in claim 1 including providing at least one anchor opening defining a through opening extending from said upper support surface to said lower base surface and providing an anchoring rod extending in said anchor opening below ground surface level to anchor said foundation system.

6. The method as claimed in claim 5 including connecting said anchoring rod with a concrete reinforcing rod.

7. The method as claimed in claim 6 wherein said providing at least one anchor opening comprises providing a plurality of said anchor openings and wherein said providing said anchoring rod comprises providing a plurality of anchoring rods, one in each of said anchor openings.

8. The method as claimed in claim 7 including connecting said anchoring rods with said concrete reinforcing rod.

9. The method as claimed in claim 1 wherein said providing said foundation system includes providing at least two of said elongated bodies and a connector and mechanically connecting said at least two elongated bodies in tandem with said connector.

10. The method as claimed in claim 9 wherein said connector comprises end portions adapted to be joined with one of said elongated bodies and a central portion joining said end portions.

11. The method as claimed in claim 9 wherein said connector comprises complementary engaging shapes at the end of said elongated bodies.

12. A method of constructing an architectural structure, said method comprising:

providing a foundation system comprising an elongated body having a lower base surface, an upper support surface and side surfaces between said lower base surface and said upper support surface;

supporting said base surface on a ground surface;

supporting at least a portion of the architectural structure with said upper support surface;

defining a concrete form with said elongated body, said concrete form adjacent said upper support surface, said concrete form including a generally vertical support surface extending upwardly from said upper support surface and extending substantially the longitudinal length of said elongated body;

pouring a concrete slab in situ against said upper support surface and said generally vertical support surface and wherein the concrete slab is at least partially contained by said generally vertical support surface while curing, wherein said concrete slab is supported with said upper support surface, wherein said foundation system provides both a support for said concrete slab and a form for use in pouring said concrete slab and making said body substantially from a polymeric material wherein said foundation system further provides thermal insulation for said concrete slab.

13. The method as claimed in claim 12 wherein said polymeric material comprises one chosen from (i) a high density crush resistant material and (ii) an extruded polystyrene insulation.

14. The method as claimed in claim 12 including providing a guard substantially over at least one of said side surfaces.

15. The method as claimed in claim 12 including adding fill material above said ground surface within said elongated body to a level generally at said upper surface prior to said pouring a concrete slab.

16. An architectural structure, comprising:

a foundation system comprising an elongated body having a lower base surface, an upper support surface and side surfaces between said lower base surface and said upper support surface, wherein said base surface is adapted to be supported on a ground surface and wherein said upper support surface is adapted to supporting at least a portion of a structure;

said elongated body defining a concrete form adjacent said upper support surface, said concrete form including a generally vertical support surface extending substantially the longitudinal length of said elongated body, wherein said upper support surface defines an upwardly opening trough thereby dividing said upper support surface into two upper surface portions and wherein said generally vertical support surface extends upwardly from one of said upper support surface portions, said trough having a lower surface terminating between said upper support surface and said lower base surface; and a concrete slab that is poured in situ against said upper support surface and said generally vertical support surface, wherein said concrete slab is supported with said upper support surface and is contained by said generally vertical support surface while curing, wherein said foundation system provides both a support for said concrete slab and a form for use in pouring said concrete slab.

17. The architectural structure as claimed in claim 16 wherein at least one of said side surfaces is at an acute angle to said base surface.

18. The architectural structure as claimed in claim 17 wherein both of said side surfaces are at an acute angle to said base surface and wherein said side surfaces are closer together adjacent said upper support surface than adjacent said base surface.

19. The architectural structure as claimed in claim 16 including a concrete reinforcing rod in said trough, said reinforcing rod being in said slab.

20. The architectural structure as claimed in claim 16 including at least one anchor opening defining a through opening extending from said upper support surface to said lower base surface and including an anchoring rod extending in said anchor opening below ground surface level to anchor said foundation system.

21. The architectural structure as claimed in claim 20 wherein said anchoring rod is connected with a concrete reinforcing rod.

22. The architectural structure as claimed in claim 21 wherein said at least one anchor opening comprises a plurality of said anchor openings and wherein said anchoring rod comprises a plurality of anchoring rods, one in each of said anchor openings.

23. The architectural structure as claimed in claim 22 wherein said anchoring rods are connected with said concrete reinforcing rod.

24. The architectural structure as claimed in claim 16 wherein said foundation system includes at least two of said elongated bodies and a connector that is adapted to mechanically connect said at least two elongated bodies in tandem.

25. The architectural structure as claimed in claim 24 wherein said connector comprises end portions adapted to be joined with one of said elongated bodies and a central portion joining said end portions.

26. The architectural structure as claimed in claim 24 wherein said connector comprises complementary engaging shapes at the end of said elongated bodies.

27. An architectural structure, comprising:

a foundation system comprising an elongated body having a lower base surface, an upper support surface and side surfaces between said lower base surface and said upper support surface, wherein said base surface is adapted to be supported on a ground surface and wherein said upper support surface is adapted to supporting at least a portion of a structure;

said elongated body defining a concrete form at said upper support surface, said concrete form including a generally vertical support surface extending upwardly from said upper support surface and extending substantially the longitudinal length of said elongated body;

a concrete slab that is poured in situ against said upper support surface and said generally vertical support surface, wherein said concrete slab is supported with said upper support surface and is contained by said vertical support surface while curing, wherein said foundation system provides both a support for said concrete slab and a form for use in pouring said concrete slab; and wherein said body is made substantially from a polymeric material wherein said foundation system further provides thermal insulation for said concrete slab.

28. The architectural structure as claimed in claim 27 wherein said polymeric material comprises one chosen from (i) a high density crush resistant material and (ii) an extruded polystyrene insulation.

29. The architectural structure as claimed in claim 16 including a guard substantially over at least one of said side surfaces.

* * * * *

UNITED STATES PATENT AND TRADEMARK OFFICE

CERTIFICATE OF CORRECTION

PATENT NO. : 8,011,158 B1
APPLICATION NO. : 12/060907
DATED : September 6, 2011
INVENTOR(S) : Kelly J. Powell It is certified that error appears in the above-identified patent and that said Letters Patent is hereby corrected as shown below:

Column 7

Line 4, Claim 12, "slab and" should be --slab and;--

Line 4, Claim 12, "making said body" should be the beginning of the last clause in Claim 12

Signed and Sealed this
Fifth Day of March, 2013

Teresa Stanek Rea

Teresa Stanek Rea
*Acting Director of the United States Patent and Trademark Office*